US005602931A

United States Patent [19]

Geisenberger

[11] Patent Number: 5,602,931

[45] Date of Patent: Feb. 11, 1997

[54] CONNECTION LINE

[75] Inventor: Stefan Geisenberger, Straubing, Germany

[73] Assignee: Nokia Technology GmbH, Pforzheim, Germany

[21] Appl. No.: 537,462

[22] Filed: Oct. 2, 1995

[30] Foreign Application Priority Data

Oct. 20, 1994 [DE] Germany ..... 44 37 476.3

[51] Int. Cl.[6] ..... H04R 25/00

[52] U.S. Cl. ..... 381/194; 381/204

[58] Field of Search ..... 381/194, 199, 381/204, 205, 192, 195

[56] References Cited

U.S. PATENT DOCUMENTS 1,995,080 3/1935 Shotwell ..... 381/194

2,010,529 8/1935 van Urk ..... 381/194

4,539,442 9/1985 Puls et al. ..... 381/194

5,027,412 6/1991 Hayashi et al. ..... 381/194

*Primary Examiner*—Sinh Tran

*Attorney, Agent, or Firm*—Ware, Fressola, Van Der Sluys & Adolphson

[57] ABSTRACT

According to the invention, a contact for loudspeakers (10) is indicated between the wire ends (24) of voice coil (16) and the stationary contacts (19), which is temperature-stable even above 250° C. This is achieved by first conductively connecting the wire ends (24) to the connecting lines (21), and then attaching the connected parts (21, 24) at least to one side of a high-temperature-resistant plastic foil (25). The plastic foil (25) is affixed to the diaphragm (13) or the voice coil support (14) by mechanical attachment means (23). The fact that the plastic foil (25), which stabilizes the connecting lines (21), is installed afterwards, allows the connection between the wire ends (24) and the connecting lines (21) to be performed by the ultrasonic welding technique.

3 Claims, 4 Drawing Sheets

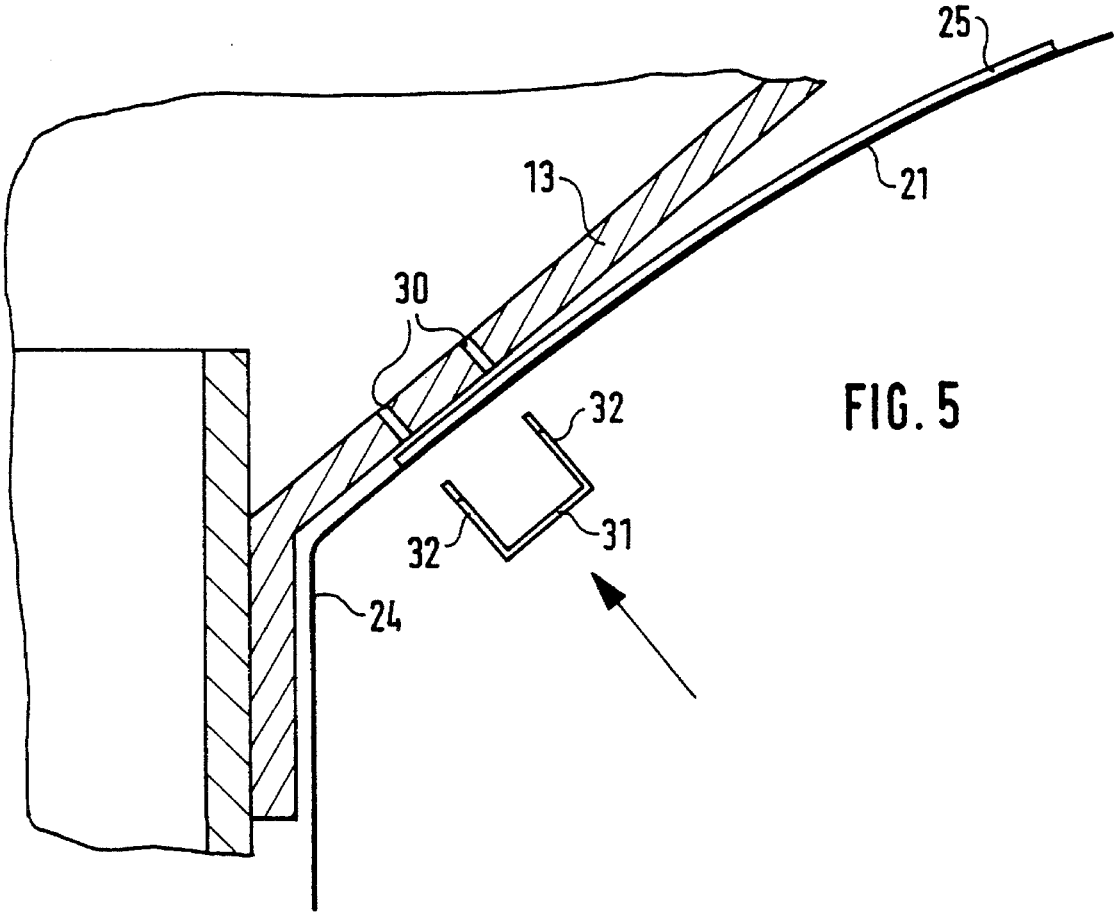
FIG. 5
FIG. 6
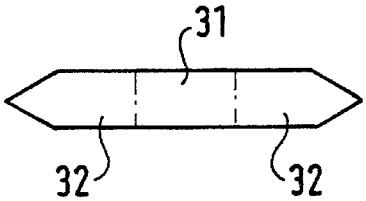

CONNECTION LINE

TECHNICAL FIELD

The invention concerns the development of connection lines to establish contact in loudspeakers between the wire ends of the voice coil and the stationary loudspeaker connections, particularly with the development of such high-temperature-resistant connections.

BACKGROUND OF THE INVENTION

In the state of the art, contact between the wire ends of the voice coil and the stationary loudspeaker connections are mostly accomplished in such a way, that each bare end of the voice coil wire, i.e. from which baking lacquer and insulation have been removed, is connected to the respective stationary contact point by a connection line. To ensure movement of the diaphragm or the voice coil support, the connection lines between the wire ends of the voice coil and the stationary contact points on the loudspeaker are formed so that they span the lateral distance between the wire ends and the connections in the form of a bow. The bow-shaped course of the connection lines is designed so that a separation remains between the underside of the diaphragm and the connection lines, to prevent the connection lines from touching the diaphragm under the effect of the excursion movements of the oscillating loudspeaker parts.

This requires connection lines which on the one hand are dimensionally stable so as to maintain the bow-shaped course, and on the other exert no, or only a small, effect on the excursion movements of the oscillating loudspeaker parts, in spite of their dimensional stability. Because of the effective excursion movements and the bending forces exerted thereby against the connection lines, it is further necessary for the connection lines to contain a high degree of fatigue strength under reversed bending stresses, if a long loudspeaker service life is to be guaranteed.

Connection lines that fulfill these requirements are made of a woven wire mesh and most often contain a plastic core. Such connection lines are also called stranded loudspeaker conductors.

The connection of these stranded loudspeaker conductors to the wire ends of the voice coil is achieved by soldering. However, this type of connection is not uncritical. If the wire ends of the voice coil are held together with the strands of the connection lines while the soldering takes place, the baking lacquer and the insulation jacket of the wire ends are burned through the effect of the soldering heat, as well as the plastic core of the stranded loudspeaker conductor in the area where the wire ends and the strands are exposed to the soldering heat. Since the stranded loudspeaker conductors are made of woven wire mesh, and are therefore very inclined to accept the solder under the capillary effect, the soldering must be very accurate, i.e. take place within a precisely defined period of time. Even small increases in the soldering time and/or the soldering temperature lead to the burning of large areas of the plastic core, or extra solder is deposited into the stranded conductors, thereby allowing solder to permeate into longer areas of the stranded conductor. The latter results in longer than anticipated areas being solidified by the cooling solder. A further consequence is that under the effect of the excursion movements, the stranded conductors break in the area that was unwontedly permeated by solder.

When the stranded loudspeaker conductors have been conductively attached to the wire ends, the connection area on the diaphragm and/or the voice coil support is additionally protected by means of an adhesive.

The connection of the loudspeaker conductors to the contacts is mostly accomplished as a soldered connection, since soldering is less critical on this side of the conductors because of the fewer bending stresses in that area. It is also known to make the connection between conductor and contact in clamped form, which entirely eliminates any remaining soldering problems.

If loudspeakers must be exposed to more than 250°, the technique explained so far can no longer be used. This is so because the safeguard of the adhesive connection between the conductors and the wire ends loosens. The result is that the separating connection areas lead to an all-out malfunction of the loudspeaker, because the wire ends of the voice coil in the separated connection areas are exposed to high bending stresses due to the excursion movements of the oscillating loudspeaker parts, and will quickly break since they are not designed for such loads.

Furthermore, such temperatures create the additional problem of softening of the soldered areas, thus dissolving the connection between the wire end and the conductor.

To solve these problems of high-temperature-affected loudspeakers, an arrangement is known from DE 42 41 12.9, whereby contact of the voice coil wire ends is achieved with a spring arrangement located on the pole body of the loudspeaker, without exposing the voice coil wire ends to bending stresses. With the known arrangement, a soldered connection between the wire ends and the respective contact parts of the spring arrangement can be omitted, if clamping devices are provided on the contact parts, for example.

From DE 44 19 311.4 it is also known to use the conductive segments of a centering diaphragm, which are insulated from the voice coil support to which the voice coil wire ends are routed. The voice coil wire ends are connected to the respective segments of the centering diaphragm by means of ultrasonic welding.

Aside from the fact that the last two arrangements are very costly, they also require production arrangements that deviate considerably from the production lines of conventional loudspeakers comprising bow-shaped connection lines. As before, there is still the need for a connection line and loudspeaker contacts that can withstand over 400° of temperature and can be produced simply, i.e. without vast changes in the conventional production lines.

SUMMARY OF THE INVENTION

If the respective connection line and its end area, which is conductively attached to the bare wire ends of the voice coil, is equipped at least on one side with a band-shaped high-temperature-resistant plastic foil and attachment straps are provided on the plastic foil which can be attached to the diaphragm and/or the voice coil support by means of fasteners, a voice coil contact is created, which can be manufactured on existing production lines without the need for additionally bonding the connection between the wire ends and the connection lines with an adhesive. It should be pointed out in this respect that it is especially advantageous to arrange the plastic foil on the side of the connection line that faces the diaphragm or the voice coil support, since the plastic foil simultaneously insulates the connection lines on this side from the metal diaphragms or metal voice coil supports of the thermally loaded loudspeakers. The realization of such a voice coil contact on a conventional production line only differs in that, after the wire ends have been connected to the connection lines, the latter are provided with the plastic foil in an additional step, and the attachment straps on the plastic foil are fastened to the diaphragm and/or the voice coil support.

If the respective end areas of the connection lines are attached to the respective wire ends of the voice coil by ultrasonic welding, the problems which take place with conventional soldering connections are avoided. The ultrasonic welding can only be accomplished because contrary to the state of the art, the connection lines do not contain any plastic cores, and the stabilizing effect of the plastic material is achieved by installing the plastic foil only after the wire ends have been attached to the connection lines. It is of special advantage if the connection lines are made of woven wire mesh. In addition to the good flexibility of such connection lines, this also has the advantage that a connection between the foil and the connection line can be established very simply by thermally softening the plastic foil, and just pressing the wire mesh into the foil.

If the connection line is made by placing a conducting path on a plastic foil, a subsequent covering of the connection line with the plastic material can be omitted. Such connection lines laminated on plastic foil can be purchased ready-made. Connecting the conducting path, which is already laminated on the plastic foil, to the respective wire ends of the voice coil is preferably accomplished by electric welding. This is so because ultrasonic welding can damage the already installed plastic foil of this process step, which can potentially remove the electric insulation which the foil provides to the connection lines against the metallic oscillating loudspeaker parts (voice coil, diaphragm).

If at least two connection lines, which are laterally separated from each other, are arranged on a plastic foil, special attaching straps are superfluous, because in this case the plastic area between the two connection lines can be used as an attaching strap.

If a U-shaped clamp is used as the attaching means which penetrates into the plastic foil and the diaphragm or the voice coil support, the use of only one such clamp is a sufficient attachment if the cross-piece of the clamp connecting the shanks runs parallel to the respective connection lines.

If the ends of the shanks are pointed, in addition to the advantage of weight saving, it also has the advantage that the plastic foil does not require any preliminary perforation to prevent migration.

If the bent ends of the shanks are positioned directly on the surface of the diaphragm or the voice coil support, the two parts can in addition be ultrasonically welded to each other, if both the clamp and the diaphragm or the voice coil support are made of an ultrasonically weldable material.

The connection between the connection line and the diaphragm or the voice coil support is particularly simple if a small plate is provided and ultrasonically welded to the diaphragm and/or the voice coil support through an opening in the plastic foil.

BRIEF DESCRIPTION OF THE DRAWINGS

FIG. 5 is another illustration of FIG. 1;

FIG. 6 is a development of a clamp;

BEST MODE FOR CARRYING OUT THE INVENTION

The invention will now be explained in greater detail by means of the figures.

Figure 1:
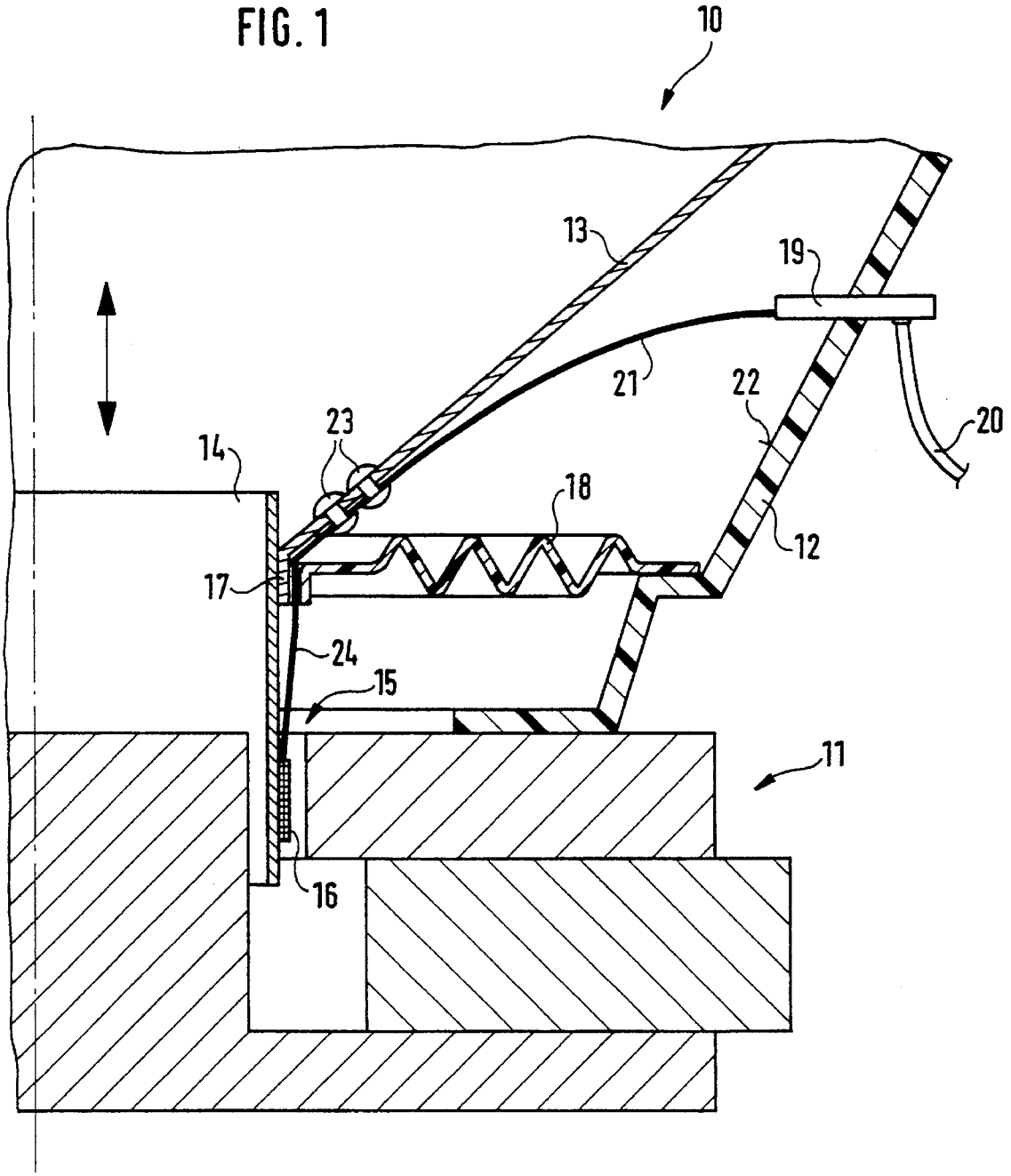
FIG. 1 is a cross sectional detail of a loudspeaker.

FIG. 1 is a cross section of mostly conventionally built loudspeaker 10, wherein an illustration of the areas left of center line and the above the loudspeaker 10 has been omitted.

This loudspeaker 10 essentially comprises a magnet system 11, a loudspeaker frame 12, a diaphragm 13 and a voice coil support 14. The magnet system 11 is connected to the loudspeaker frame 12. The tube-shaped voice coil support 14 is located in the air gap 15 formed in the magnet system 11. The voice coil 16 is wound around the end of the voice coil support 14, which extends into the air gap 15. The other end of the voice coil support 14 is connected to the loudspeaker diaphragm 13. In the present case, the voice coil support 14 and the diaphragm 13 are made of aluminum and are ultrasonically welded. Only for the sake of completeness it is pointed out that the upper edge of the diaphragm 13, which faces away from the voice coil support 14, is connected to the loudspeaker frame 12 by a so-called bead (not illustrated).

A centering diaphragm is positioned between the neck 17 of diaphragm 13 and the loudspeaker frame. In addition, a conductive contact 19 is inserted into the loudspeaker frame 12, which in the present case is made of a high-temperature-resistant plastic. It should be pointed out at this time that in another—not illustrated—configuration example, the loudspeaker frame 12 can also be made of another high-temperature-resistant material (ceramic or metal). In the illustration of FIG. 1, this contact 19 is connected to one of two sound signal lines 20.

A connecting line 21 is provided to conduct the low-frequency sound signals from the connecting contacts 19 to the voice coil 16. This connecting line 21, whose configuration will be described in more detail further on, is bow-shaped and leads from the side of the connecting contact 19 located on the inside 22 of the frame 12, to the diaphragm 13, where it is affixed by two mechanical attachments 23 in the form of rivets. The respective wire ends 24 of voice coil 16 also lead along the outer jacket of voice coil support 14 to the attachment area, where they are conductively attached to the respective connection lines 21. How the connection line 21 is configured, and how the contact of the connection line 21 with the respective wire end 24 of voice coil 16 takes place, is explained in detail in conjunction with FIGS. 2 to 4.

Figure 2:
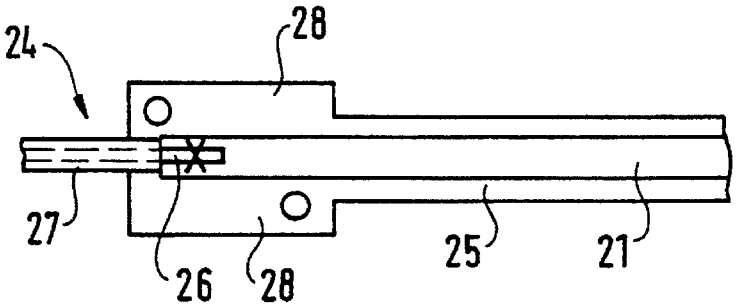
FIG. 2 is a top view of a contact between wire end and connection line.

FIG. 2 depicts a connection line 21, which is formed of a band-shaped wire mesh made of a copper-beryllium alloy. This connection line 21 is positioned on and connected to a high-temperature-resistant, band-shaped plastic foil 25. In addition, one wire end 24 of voice coil 16 leads to the connection line 21. The wire end 24 is sheathed with insulation 27 (self-bonding lacquer in this instance) to the end area 26 located on connection line 21. The wire end 24 is ultrasonically welded to connection line 21 in the area where the bare end 26 of wire 24 and the connection line 21 overlap, and which is marked with X. Attachment straps 28 are formed on the plastic foil 25 near the welding area X, which serve to connect it to the diaphragm 13 (FIG. 1).

In the present case, the plastic foil 25 is made of polyamide material. Such a material resists temperatures to above 400° C. and can be purchased commercially, for example, from the Dupont Company under the brand name of Kapton®.

To realize an arrangement as depicted in FIG. 2, the overlapping areas of wire end 24 and connecting line 21 are pressed together between the "Sonotrode" and the counter-electrode of a (not illustrated) ultrasonic welding machine, and ultrasonically welded. The fact that in this condition the end area 26 of wire 24 which rests against connecting line 21 is still sheathed by self-bonding lacquer, is immaterial because the self-bonding lacquer "burns up" during the ultrasonic welding.

The connecting area and the connecting line 21 are then joined to the plastic foil 25 made of polyamide material, by pressing the wire mesh into the plastic foil 25 under the effect of heat. To insulate the connection electrically, it is essential for the plastic foil 25 to extend beyond the area of wire end 24, which is still sheathed by self-bonding lacquer or insulation material 27, if the diaphragm 13 and/or the voice coil support 14 is/are made of metal.

Following this process, the side of the plastic foil 25 that faces away from the side with the connecting line 21 is placed against the diaphragm 13 (FIG. 1), and is attached to the diaphragm 13 by means of the rivets 23 (FIG. 1) that pass through the attachment straps 28 and diaphragm 13.

Figure 3:
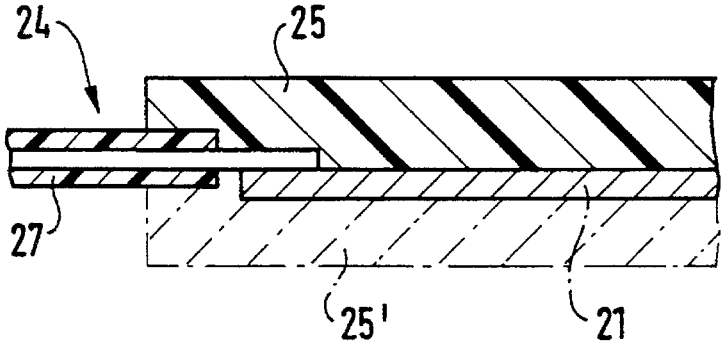
FIG. 3 is an cross sectional illustration of FIG. 2.

FIG. 3 depicts a cut through an arrangement according to FIG. 2. Deviating from the illustration in FIG. 2, another plastic foil 25' (in broken lines) is present. The connecting line 21 and the wire end 24 are placed between these two plastic foils 25, 25', so that both parts 21, 24 are fully sheathed by the two plastic foils 25, 25'. This full sheathing of parts 21, 24 can be configured so that both foils 25, 29 are thermally softened and pressed against each other while the connecting line 21 and wire end 24 are interposed between them.

Figure 4:
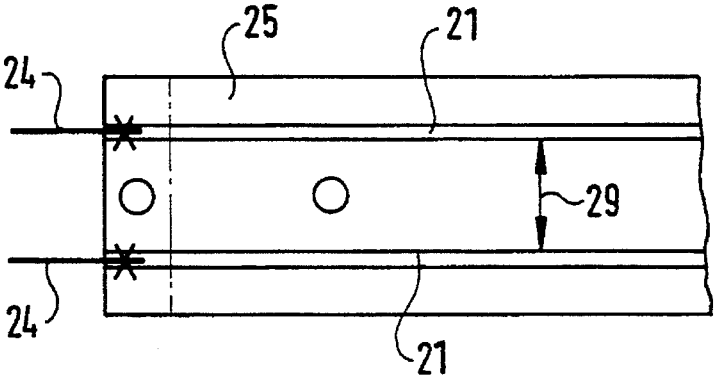
FIG. 4 is another illustration of FIG. 2.

FIG. 4 depicts a plastic foil 25 on which two connecting lines 21 are placed at a lateral distance from each other. This was achieved by evaporating copper onto a plastic foil made of polyamide, and etching the conducting paths for the connecting lines 21 thereon. Two wire ends 24 of voice coil 16 are routed to these two connecting lines 21. In the present case, the connection between the laminated connecting lines 21 and the respective wire ends 24 is made by electric arc welding, since ultrasonic welding can possibly damage the plastic foil 25 already present in the welding area X. However, this does not mean that the ultrasonic welding technique cannot be used in conjunction with the connecting lines 21 that are evaporated onto the plastic foil 25 as illustrated in FIG. 4. For example, if the conducting paths 21 formed on the plastic foil 25 are connected to the wire ends 24 by means of ultrasonic welding, and the area of the plastic foil 25 marked by broken lines is damaged thereby, such a connecting line 21 can still be used for the purposes elaborated here, if the surface of foil 25, on which the conducting path 21 is formed, is connected to another foil 25' (see FIG. 3) which covers the welding area X up to diaphragm 13. In addition, ultrasonic welding of an arrangement as shown in FIG. 4 and comprising only one foil 25 can also be used in all cases where the insulation of the connection areas between the wire ends 24 and the conducting paths 21 plays a subordinated role. The latter applies if the diaphragm 13 (FIG. 1) is made of an insulation material.

As can furthermore be seen in FIG. 4, the formation of special attachment straps 28 can be omitted, since the foil area 29 between the two conducting paths 21 can simply be used for the attachment to the diaphragm 13 (FIG. 1).

Figure 7:
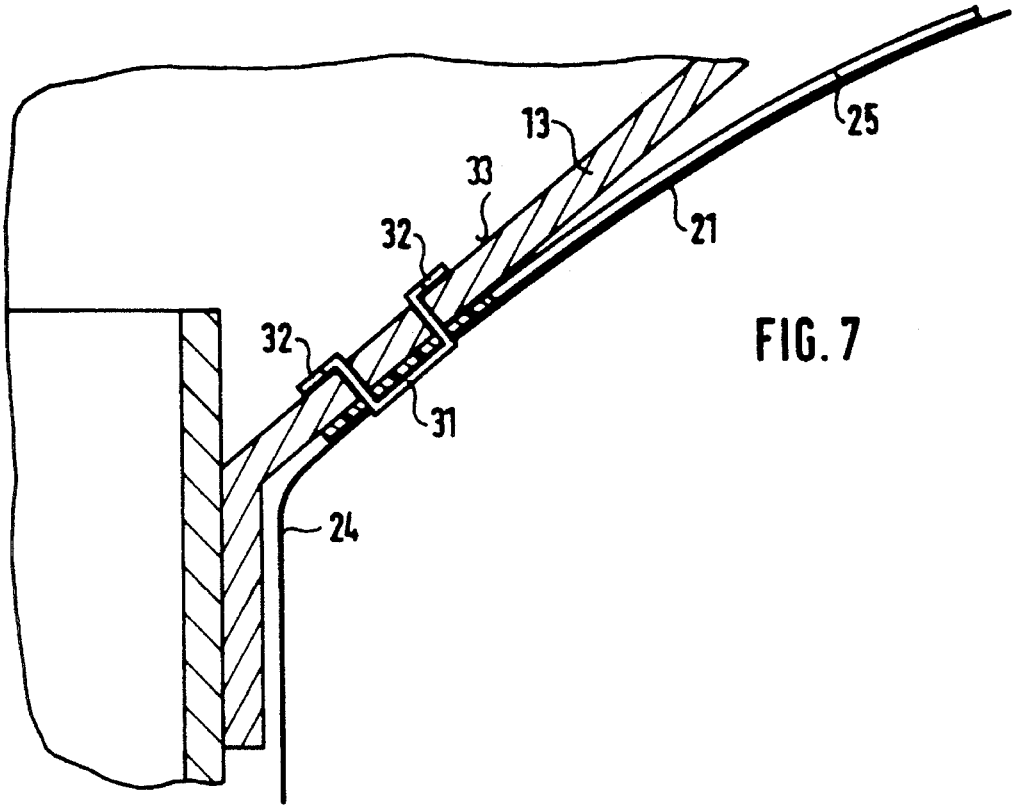
FIG. 7 is another illustration of FIG. 4.

FIG. 5 depicts an attachment of a foil 25 supporting two connecting lines 21 to the diaphragm 13, where a precise illustration of the connecting lines 21 and the wire ends 24 was omitted for reasons of clarity. It is only essential in FIG. 5 that the diaphragm 13 contains two slit-shaped openings 30, and that a U-shaped clamp 31 is available for the connection. To establish the connection between diaphragm 13 and plastic foil 25, the legs 32 of the U-shaped clamp 31, whose development is shown in FIG. 6, are moved in the direction of the arrow toward the openings 30. Since the ends of legs 32 are pointed (FIG. 6), they penetrate through the foil area 29 between the two connecting lines 21 (FIG. 4) before they penetrate into the openings 30. A final connection is obtained by bending the legs 32 after they have penetrated through the openings 30. It is then very advantageous if the clamp connection is configured as illustrated in FIG. 7. If the legs 32 are bent outward on the top side 33 of diaphragm 13 as shown in FIG. 7, and the diaphragm 13 and the clamp 31 are made of metal, the two parts can be ultrasonically welded in a particularly good fashion, because in that case only the two parts 13, 31 lie directly on top of each other and no plastic material is present in this area, and furthermore both sides of parts 13, 31 are accessible to the electrodes of the ultrasonic welding machine.

Figure 8:
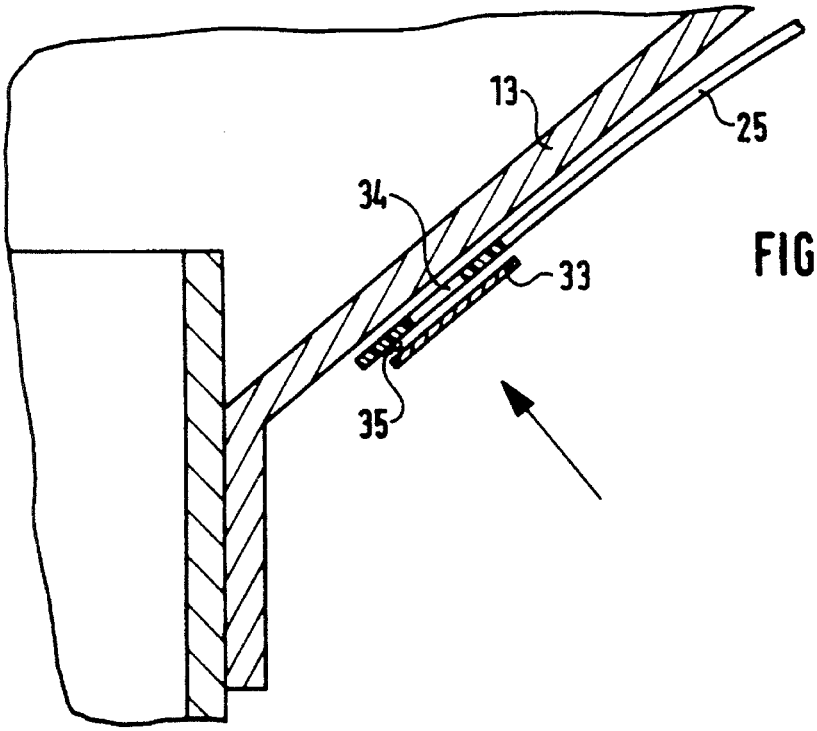
FIG. 8 is another illustration of FIG. 7.

The ultrasonic weldability of the attachment of plastic foil 25 to diaphragm 13 is also provided if a thin flat plate 33 and a plastic foil 25 with a hole 34 are used, as shown in FIG. 8. If this small plate 33, which is larger than the hole 34, is pressed against the diaphragm 13 in the direction of the arrow, the side 35 of small plate 33, which faces the diaphragm 13, penetrates into the hole 34 and makes contact with diaphragm 13. If both parts 13, 33 are made of ultrasonically weldable metals, the welding can begin if both parts 13, 33 touch through the hole 34 in plastic foil 25. It is only pointed out for reasons of completeness that the parts 13, 25 and 33 in FIG. 8 are illustrated at a distance from each other for better clarity.

Additionally it should be pointed out that the connection depicted here only for the diaphragm 13, is also applicable to the voice coil support 14.

Nor is the use of the invention only limited to loudspeakers which are subjected to elevated ambient temperatures.

Furthermore, it goes without saying that the connecting lines 21 equipped with the plastic foil 25 can also be connected to the respective contacts 19 in the manner used for the connection to the wire ends 24.

What is claimed is:

1. A connection for loudspeaker contacts of a loudspeaker having a diaphragm (13) and a voice coil (14) between bare wire ends (24) of a voice coil (16) and stationary contacts (19) on a loudspeaker frame (12), said connection comprising connecting lines (21), each connecting line including an end area, each end area is conductively connected to the respective bare wire end (24) of the voice coil (16), wherein a high-temperature-resistant, band-shaped plastic foil (25) is equipped, at least on one side of the connecting line, wherein attachment straps (28) are provided on the plastic foil (25), said attachment straps are affixed to the diaphragm (13) by means of attachment means (23, 31, 33), wherein said each connecting line is formed of a conducting path (21) laminated to the plastic foil (25), and an end area of the conducting path (21) is connected to the respective bare wire end (24) of the voice coil (16) by means of electric arc welding.

2. The connection as claimed in claim 1 further comprises at least two of the connecting lines (21), said at least two connecting lines are arranged on the plastic foil (25) at a lateral distance from each other, and that the attachment means (23) pass through the plastic area (29) that exists between said at least two connecting lines (21).

3. A connection for loudspeaker contacts of a loudspeaker having a diaphragm (13) and a voice coil support (14) between bare wire ends (24) of a voice coil (16) and stationary contacts (19) on a loudspeaker frame (12), said connection comprising at least two connecting lines (21), each connecting line including an end area, each end area of each connecting line is conductively connected to the respective bare wire end (24) of the voice coil (16), wherein a high-temperature-resistant, band-shaped plastic foil (25) is equipped at least on one side of said at least two connecting lines, wherein attachment straps (28) are provided on the plastic foil (25), said attachment straps (28) are affixed to the diaphragm (13) by means of attachment means (23, 31, 33), wherein the end areas of said at least two connecting lines (21) are attached to the respective wire ends (24) of the voice coil (16) by means of ultrasonic welding, and said at least two connecting lines (21) are arranged on the plastic foil (25) at a lateral distance from each other, and said attachment means (23) pass through at least a plastic area (29) of the plastic foil (25) that exists between the two connecting lines (21).

* * * * *